US012740684B1

(12) United States Patent
Contreras

(10) Patent No.: US 12,740,684 B1
(45) Date of Patent: Sep. 22, 2026

(54) MULTI-SURFACE SCRUBBING PAD

(71) Applicant: Marisol Contreras, Brooklyn, NY (US)

(72) Inventor: Marisol Contreras, Brooklyn, NY (US)

( * ) Notice: Subject to any disclaimer, the term of this patent is extended or adjusted under 35 U.S.C. 154(b) by 623 days.

(21) Appl. No.: 18/103,675

(22) Filed: Jan. 31, 2023

(51) Int. Cl.
*A47L 13/12* (2006.01)
*A47L 13/06* (2006.01)
*A47L 13/16* (2006.01)

(52) U.S. Cl.
CPC ..... *A47L 13/12* (2013.01); *A47L 13/06* (2013.01); *A47L 13/16* (2013.01)

(58) Field of Classification Search
CPC ..... A47L 13/03; A47L 13/04; A47L 13/06; A47L 13/12; A47L 13/16; A47L 13/17
USPC ..... 15/111, 244.1, 244.2, 244.3, 229.11, 15/229.12, 229.13
See application file for complete search history.

(56) References Cited

U.S. PATENT DOCUMENTS 2,026,638 A * 1/1936 Kingman ..... A47L 13/03 15/104.93
3,040,353 A * 6/1962 Gray ..... B29C 66/712 15/118
3,175,331 A * 3/1965 Klein ..... A47L 17/08 401/201
3,638,270 A * 2/1972 Schlegel, Jr. ..... A47L 13/16 15/209.1
5,361,445 A * 11/1994 Giallourakis ..... A47L 13/16 15/118
5,671,498 A * 9/1997 Martin ..... A47K 7/03 15/118
6,289,547 B1 9/2001 Narula et al.
6,993,805 B2 * 2/2006 Prodoehl ..... A47L 17/08 15/118
7,629,043 B2 12/2009 Lindsay et al.
2007/0079462 A1 * 4/2007 Haskett ..... A47L 17/08 15/118
2018/0263455 A1 * 9/2018 Weinberger ..... B25G 3/14
2022/0346621 A1 * 11/2022 Libman ..... A46B 5/0095

FOREIGN PATENT DOCUMENTS

DE 39 26 524 A1 * 2/1991

OTHER PUBLICATIONS

DE 3926524 A1; Feb. 14, 1991; Schneider.*

* cited by examiner

*Primary Examiner* — Joseph A Stoklosa
(74) *Attorney, Agent, or Firm* — Sanchelima & Associates, P.A.; Christian Sanchelima; Jesus Sanchelima

(57) ABSTRACT

A multi-surface scrubbing pad including a sponge assembly, an enclosure assembly and a brush assembly. The sponge assembly includes a sponge. The enclosure assembly encloses the sponge. The enclosure assembly includes a top portion and a bottom portion. The bottom portion is made of an abrasive material and the bottom portion is made of a fabric material. The brush assembly includes bristles attached to a front portion of the enclosure assembly. The bristles, the front portion and the rear portion are used to clean predetermined types of surfaces. The enclosure assembly is used as a grip when using the brush assembly to scrub a predetermined area.

7 Claims, 3 Drawing Sheets

MULTI-SURFACE SCRUBBING PAD

II. BACKGROUND OF THE INVENTION

1. Field of the Invention

The present invention relates to a multi-surface scrubbing pad and, more particularly, to a multi-surface scrubbing pad having multiple cleaning means in a single mechanism.

2. Description of the Related Art

Several designs for scrubbing pads have been designed in the past. None of them, however, include a sponge having an abrasive side and a soft side to clean fragile surfaces and hard surfaces.

Applicant believes that a related reference corresponds to U.S. Pat. No. 6,289,547 issued for a surgical scrub device having bristled brushes on the end of the rectangular body. Applicant believes that another related reference corresponds to U.S. Pat. No. 7,629,043 issued for a layered cleaning pad. None of these references, however, teach of a scrubbing device with an abrasive layer, a foam sponge-like layer and a brush with bristles extending from one end.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a multi-surface scrubbing pad that includes an sponge covered by an enclosure, where the enclosure has a bottom portion and a top portion, the bottom portion being covered by an abrasive material such as steel wool, or a plastic scrub layer.

It is another object of this invention to provide a multi-surface scrubbing pad that includes a brush attached to a top end of the enclosure used for scrubbing and dirt removal.

It is another object of this invention to provide a multi-surface scrubbing pad that allows efficiently cleaning surfaces, corners and crevices because of its flexibility.

It is still another object of the present invention to provide a multi-surface scrubbing pad that includes a silicone barrier to prevent liquids from getting into the sponge when using the brush.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric operational view of the present invention 10 used for cleaning the sofa 102.

FIG. 2 shows an isometric view of the present invention 10. The present invention includes a sponge assembly 20, an enclosure assembly 40 and a brush assembly 60.

V. DETAILED DESCRIPTION OF THE EMBODIMENTS OF THE INVENTION

Figure 1:
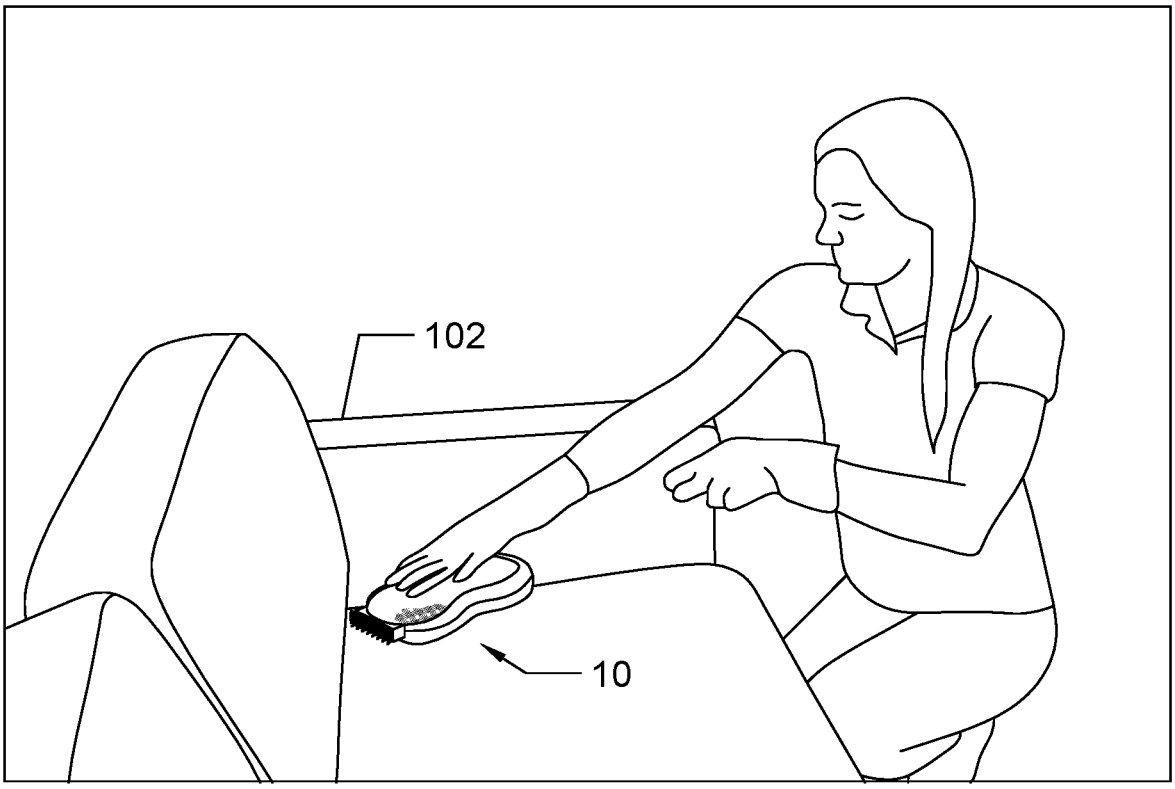

Referring now to the drawings, where the present invention is generally referred to with numeral 10, it can be observed that it basically includes sponge assembly 20, an enclosure assembly 40 and a brush assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 4:
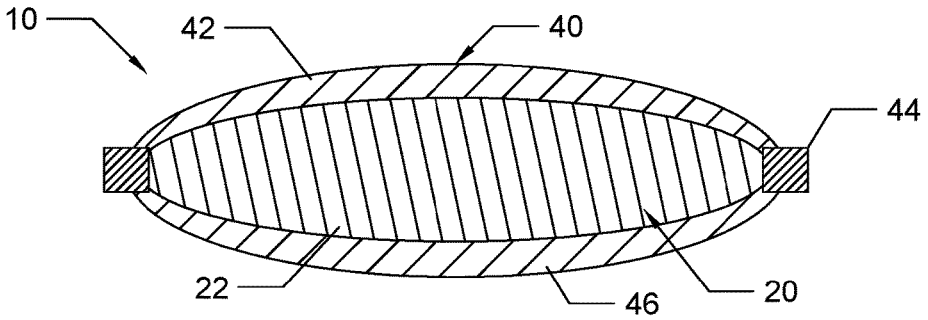
FIG. 4 is an illustration of a cross sectional view of the present invention showing of the sponge assembly 20.

As best illustrated in FIG. 4 the sponge assembly 20 may include a sponge 22. The sponge 22 may be made of polyester, polyurethane, or any other suitable material. The sponge 22 may be a soft, porous element with open-celled texture. The sponge 22 may have an oval shape. It also may be suitable for the sponge 22 to have a rectangular shape, a cylindrical shape, or any other suitable shape. The sponge 22 may be enclosed by the enclosure assembly 40.

The enclosure assembly 40 may include a top portion 42, a bottom portion 46 and a junction element 44. The top portion 42 may include an abrasive layer partially covering a portion of the top portion 42. In a preferred embodiment the abrasive layer of the top portion 42 may be made of stainless steel wire scrubber. It also may be suitable for the abrasive layer in the top portion 42 may be made of polypropylene and polyester. The top portion 42 may be used to scrub over hard surfaces. The top portion 42 may have a predetermined thickness. The top portion 42 may be attached to the bottom portion 46 by means of the junction element 44.

The junction element 44 may be made of cotton, polyester, wool, or any other suitable material. The junction element 44 may fully cover the edges of the top portion 42 and the edges of the bottom portion 46. In a preferred embodiment the junction element 44 is sewn in the edges of the top portion 42 and the edges of the bottom portion to attach together the top portion 42 and the bottom portion 46. The junction element 44 may partially protrude from the enclosure assembly 20.

The bottom portion 46 may conform with the shape of the top portion 42. The bottom portion 46 may have a predetermined thickness. The thickness of the bottom portion 46 may be smaller than the thickness of the top portion 44. The bottom portion 46 may be made of wool, cotton, polyurethane, or any other suitable material. The bottom portion 46 may have a soft texture.

Figure 2:
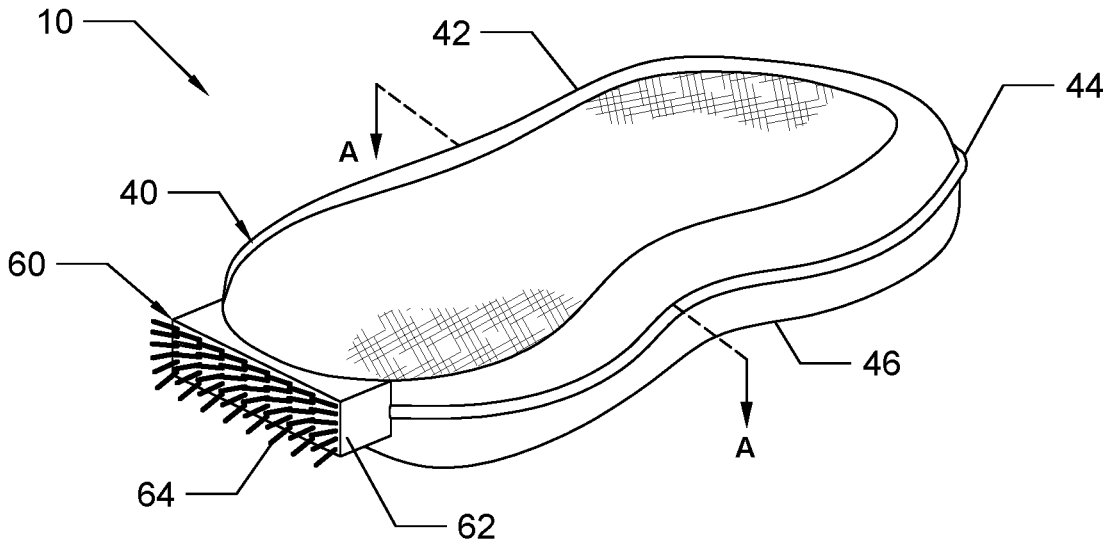
Figure 3:
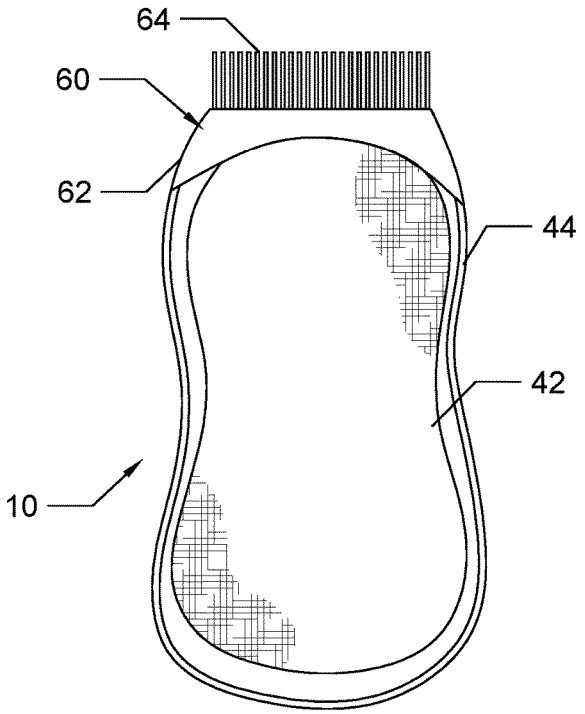
FIG. 3 illustrates a top side view of the present invention 10.
Figure 3A:
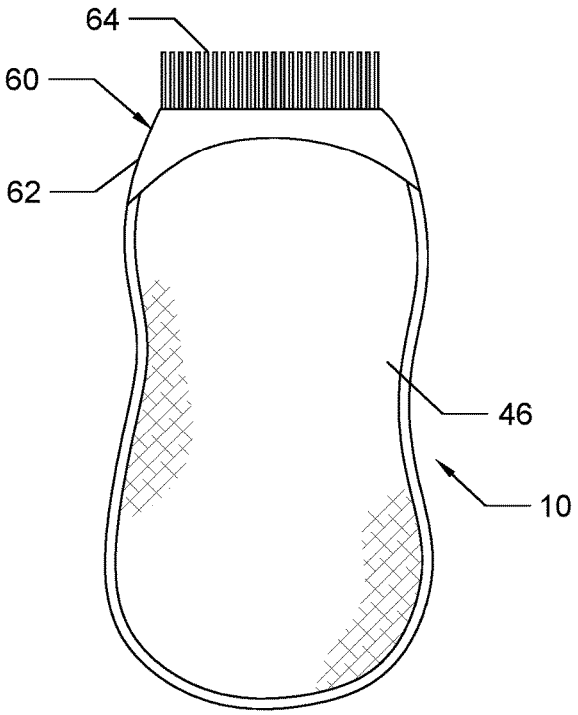
FIG. 3A depicts a bottom side view of the present invention 10.

As best illustrated in FIG. 2, the brush assembly 60 may include a base 62 and bristles 64. In a preferred embodiment the brush assembly 60 may be located on a front portion of the enclosure assembly 40. It also may be suitable for the brush assembly 60 to have any other configuration in the enclosure assembly 40. The brush assembly 60 may be integrally adapted to the enclosure assembly 40. The base 62 may be built in the front portion of the enclosure assembly 20 over a front portion of the junction element 44.

In a preferred embodiment the base 62 may be made of a polysiloxane. It also may be suitable for the base 62 to be made of polyurethane, cotton, or any other suitable material. In a preferred embodiment the base 62 may present hydrophobic characteristics. In a preferred embodiment the base 62 may be deposited as a liquid to a predetermined temperature over the front portion of the enclosure assembly 20 to form a solid base when the predetermined temperature of the base 62 is reduced. The base 62 may substantially have a tapered shape. It also may be suitable for the base 62 to have a rectangular shape, a triangular shape, or any other suitable shape. The base 62 may have a planar top end. The planar top end of the base 62 may be diametrically opposite to a bottom end attached to the front portion of the enclosure assembly 40. Water, detergent and cleaning agents may be deposited over the base 62 and the bristles 64. The base 62 may be used as a barrier for the enclosure assembly 40 to prevent water, detergent or any other product from being deposited into the sponge assembly 20. In one embodiment the base 62 may have an opening to store detergent or cleaning agents therein.

The bristles 64 may be made of polypropylene and nylon. It also may be suitable for the bristles 64 to be made of hog hair polyester, or any other suitable material. The bristles 64 may protrude from the base 62. The bristles 64 may be equidistantly disposed therebetween. The bristles 64 may be used to clean corners and edges. The enclosure assembly 40 may be used as a handle for the brush assembly 60. The present invention 10 provides a cleaning scrubbing pad having three different appliances. The present invention 10 provides such a feature in the enclosure assembly 40 that allows the present invention 10 to be introduced into crevices and to clean corners.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multi-surface scrubbing pad, comprising:

a sponge assembly;

an enclosure assembly, wherein said enclosure assembly includes a top portion and a bottom portion, wherein said bottom portion is made of fabric, said top portion is made of an abrasive material, wherein the abrasive material is a stainless steel wire scrubber material, said enclosure assembly encloses said sponge assembly; and a brush assembly, wherein said brush assembly includes bristles attached to a front portion of said enclosure assembly wherein said brush assembly further includes a base, wherein said base is built in said front portion of said enclosure assembly: wherein said base is made of a polysiloxane.

2. The multi-surface scrubbing pad set forth in claim 1, wherein said bristles protrude from said base.

3. The multi-surface scrubbing pad set forth in claim 1 wherein said bristles are equidistantly disposed therebetween.

4. The multi-surface scrubbing pad set forth in claim 1 wherein said top portion and said bottom portion are attached together by means of a junction element, wherein said junction element is a fabric strip sewn to edges of said top portion and said bottom portion.

5. The multi-surface scrubbing pad set forth in claim 1 wherein said bristles are made of a plastic material.

6. A multi-surface scrubbing pad, comprising:

a sponge assembly, wherein said sponge assembly includes a sponge, said sponge is flexible;

an enclosure assembly, wherein said enclosure assembly includes a top portion and a bottom portion, wherein said bottom portion is made of fabric, said top portion is made of an abrasive material, wherein the abrasive material is a stainless steel wire scrubber material, said enclosure assembly encloses said sponge; and a brush assembly, wherein said brush assembly includes bristles end a base, wherein said base is built in a front portion of said enclosure assembly, wherein said base is made of a polysiloxane, wherein said bristles protrude from said base, said bristles are made of a plastic material, said bristles are equidistantly disposed in said base.

7. A multi-surface scrubbing pad, consisting of:

a sponge assembly, wherein said sponge assembly includes a sponge, said sponge is flexible, said sponge substantially has an oval shape;

an enclosure assembly, wherein said enclosure assembly includes a top portion, a junction element and a bottom portion, wherein said bottom portion is made of fabric, said top portion is made of an abrasive material, said enclosure assembly encloses said sponge, wherein said junction element attaches said top portion and said bottom portion together, said junction element is a strap made of a fabric material, said junction element is sewn to said top portion and said bottom portion, wherein said top portion is a mirror image of said bottom portion, said abrasive material is stainless steel wire scrubber; and a brush assembly, wherein said brush assembly includes bristles and a base, wherein said base is built in a front portion of said enclosure assembly, wherein said base is made of a polysiloxane, wherein said bristles protrude from said base, said bristles are made of a plastic material, said bristles are equidistantly disposed in said base.

* * * * *